United States Patent [19]

Savino

[11] 4,427,119

[45] Jan. 24, 1984

[54] HIDEAWAY TIE RACK FOR SLIDING DOOR CLOSETS

[76] Inventor: Joseph Savino, 955 Ironbark Dr., Port Richey, Fla. 33568

[21] Appl. No.: 270,253

[22] Filed: Jun. 4, 1981

[51] Int. Cl.[3] ..... A47F 7/12

[52] U.S. Cl. ..... 211/94; 211/105.3

[58] Field of Search ..... 211/105.3, 94, 123, 211/162; 248/262, 265

[56] References Cited

U.S. PATENT DOCUMENTS

| | | | |
|---|---|---|---|
| 762,989 | 6/1904 | Drucker | 211/94 |
| 894,231 | 7/1908 | Purcell | 211/94 |
| 1,127,782 | 2/1915 | Kurtzon | 211/94 |
| 1,132,190 | 3/1915 | Kohout | 211/94 |
| 1,639,021 | 8/1927 | Batts | 211/94 X |
| 3,029,465 | 4/1962 | Graker et al. | 248/265 X |
| 3,175,697 | 3/1965 | Kelly | 211/162 X |
| 3,389,807 | 6/1968 | Manning et al. | 211/162 X |

*Primary Examiner*—Ramon S. Britts
*Assistant Examiner*—Robert W. Gibson, Jr.
*Attorney, Agent, or Firm*—Stanley M. Miller

[57] ABSTRACT

A hideaway tie rack is disclosed for a sliding door closet. The tie rack includes an elongated, cylindrical, hollow housing having an inner diameter of a first dimension, having a first open end and a second opposed end. The housing has an elongated, longitudinal slot extending axially along its surface, which has a circumferential width and which opens onto the first end of the housing. The housing is mounted on the back of the sliding door in a substantially horizontal orientation. The tie rack further includes an elongated cylindrical tube having an outer diameter of a second dimension which is less than the inner diameter of the housing. The tube has a first end and an opposed second end which slideably enters the first end of the housing. This enables the tube to be mounted within the hollow interior of the housing in axial sliding engagement with the housing. The tie rack still further includes a bar having a cross sectional dimension less than the circumferential width of the slot in the housing. The bar has a first end mounted to the first end of the tube, a second end mounted to the second end of the tube, and an intermediate, horizontal rack portion between the first and second ends of the bar which is suspended in spaced, parallel relationship with the tube. The rack portion projects through the slot in the housing and is in axial sliding engagement with it. In this manner, neckties may be hung from the horizontal rack portion of the bar when the tube extends out from the first end of the housing in a deployed position. Then the tube can be substantially completely inserted into the housing to form a more compact tie rack which can be concealed behind the sliding door to enable the door to be closed.

7 Claims, 8 Drawing Figures

SEC. 4-4'

HIDEAWAY TIE RACK FOR SLIDING DOOR CLOSETS

FIELD OF THE INVENTION

The invention disclosed broadly relates to article racks and more particularly relates to collapsible tie racks.

BACKGROUND OF THE INVENTION

Tie racks and other types of clothing and article racks have been devised in the prior art for use in wardrobe closets in order to make more effective use of space. Where the closet has a vertically hinged door, prior art tie racks and clothing racks have been constructed for mounting on the back of the door, so that the rack and the articles hung therefrom can be concealed when the door is closed. However, such prior art racks which are suitable for mounting on the back of vertically hinged doors, are entirely unsuited for mounting on the back of a sliding door, since access to the rack is not available when the door is slided open.

OBJECTS OF THE INVENTION

It is therefore an object of the invention to provide an improved article rack for mounting on the back of a sliding door.

It is a further object of the invention to provide an improved tie rack which can be mounted on the back of a sliding door and can selectively deploy or conceal the ties hung therefrom.

SUMMARY OF THE INVENTION

These and other objects, features and advantages of the invention are accomplished by the hideaway tie rack invention disclosed herein. A hideaway tie rack is disclosed for a sliding door closet. The tie rack includes an elongated, cylindrical, hollow housing having an inner diameter of a first dimension, having a first open end and a second opposed end. The housing has an elongated, longitudinal slot extending axially along its surface, which has a circumferential width and which opens onto the first end of the housing. The housing is mounted on the back of the sliding door in substantially horizontal orientation. The tie rack further includes an elongated cylindrical tube having an outer diameter of a second dimension which is less than the inner diameter of the housing. The tube has a first end and an opposed second end which slideably enters the first end of the housing. This enables the tube to be mounted within the hollow interior of the housing in axial sliding engagement with the housing. The tie rack still further includes a bar having a cross sectional dimension less than the circumferential width of the slot in the housing. The bar has a first end mounted to the first end of the tube, a second end mounted to the second end of the tube, and an intermediate, horizontal rack portion between the first and second ends of the bar which is suspended in spaced, parallel relationship with the tube. The rack portion projects through the slot in the housing and is in axial sliding engagement with it. In this manner, neckties may be hung from the horizontal rack portion of the bar when the tube extends out from the first end of the housing in a deployed position. Then the tube can be substantially completely inserted into the housing to form a more compact tie rack which can be concealed behind the sliding door to enable the door to be closed.

DESCRIPTION OF THE FIGURES

These and other objects, features and advantages of the invention will be more fully appreciated with reference to the accompanying drawings.

DISCUSSION OF THE PREFERRED EMBODIMENT

A hideaway tie rack is disclosed for a sliding door closet. The tie rack includes an elongated, cylindrical, hollow housing having an inner diameter of a first dimension, having a first open end and a second opposed end. The housing has an elongated, longitudinal slot extending axially along its surface, which has a circumferential width and which opens onto the first end of the housing. The housing is mounted on the back of the sliding door in a substantially horizontal orientation. The tie rack further includes an elongated cylindrical tube having an outer diameter of a second dimension which is less than the inner diameter of the housing. The tube has a first end and an opposed second end which slideably enters the first end of the housing. This enables the tube to be mounted with the hollow interior of the housing in axial sliding engagement with the housing. The tie rack still further includes a bar having a cross sectional dimension less than the circumferential width of the slot in the housing. The bar has a first end mounted to the first end of the tube, a second end mounted to the second end of the tube, and an intermediate, horizontal rack portion between the first and second ends of the bar which is suspended in spaced, parallel relationship with the tube. The rack portion projects through the slot in the housing and is in axial sliding engagement with it. In this manner, neckties may be hung from the horizontal rack portion of the bar when the tube extends out from the first end of the housing in a deployed position. Then the tube can be substantially completely inserted into the housing to form a more compact tie rack which can be concealed behind the sliding door to enable the door to be closed.

Figure 1:
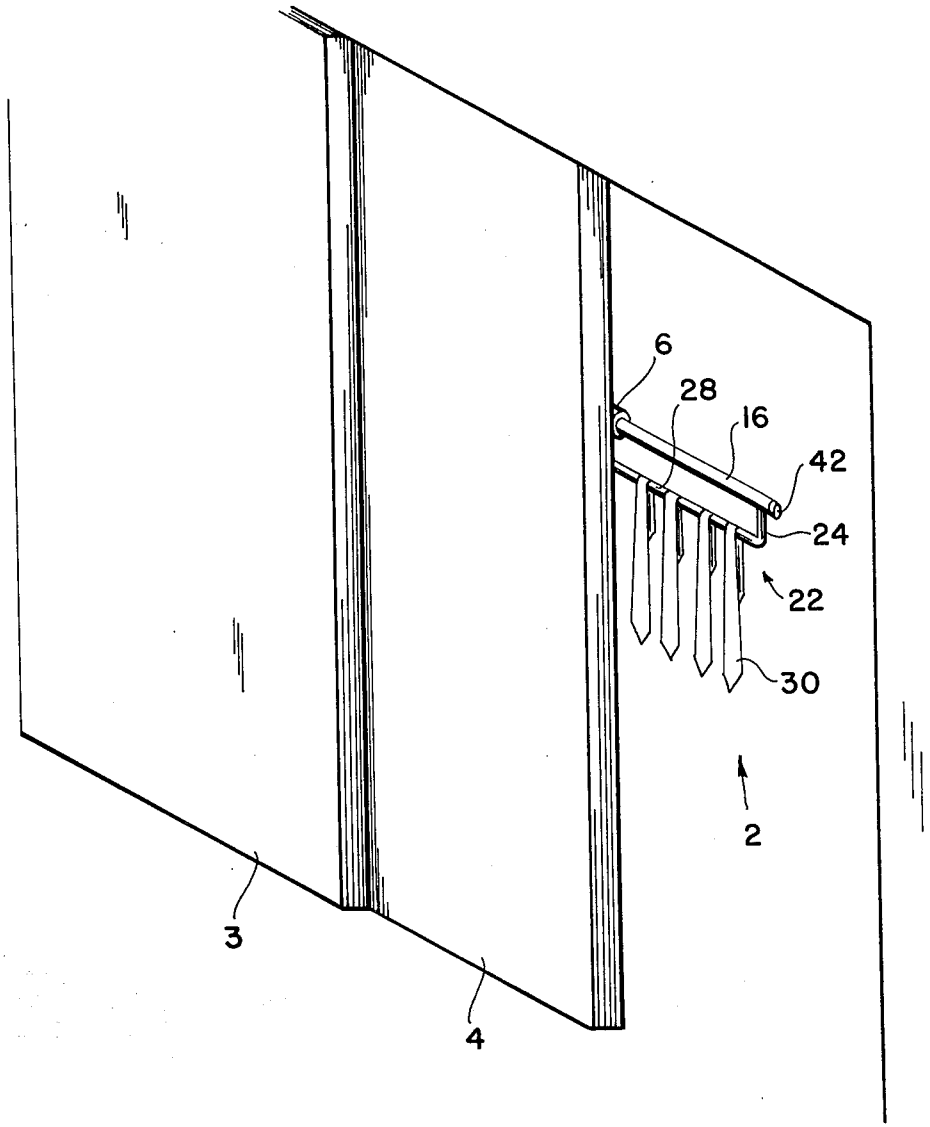
FIG. 1 is an overall view of the invention when mounted on a sliding door.
Figure 2:
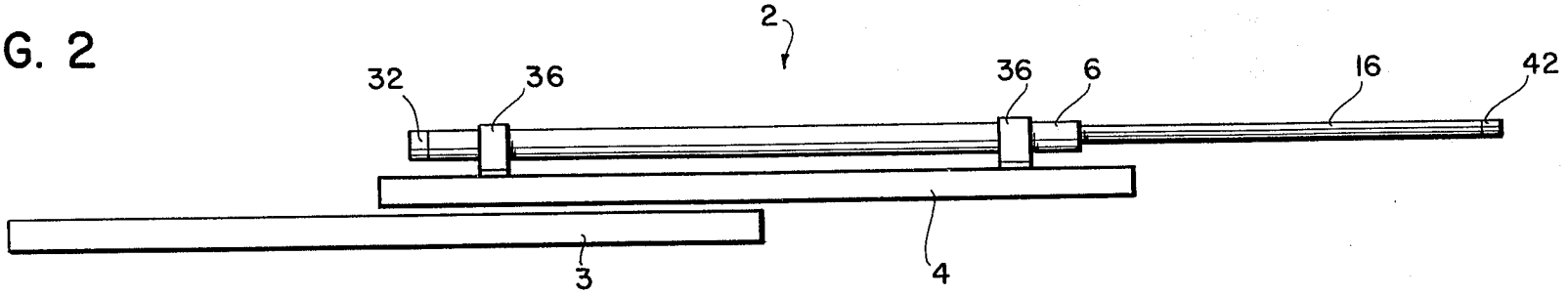
FIG. 2 is a top view of the invention showing the tube 16 in its deployed position.

FIGS. 1 and 2 show the hideaway tie rack 2 for mounting on the back of the inner door 4 of the pair of sliding closet doors 3 and 4. The tie rack 2 includes an elongated, hollow, cylindrical housing 6, as seen in FIGS. 2, 3, 4, 5 and 6, having an inner diameter of a first dimension D, as is shown in FIG. 6. The housing 6 has a first open end 8 and a second opposed end 10, with a longitudinal slot 12 extending axially along the surface thereof, having a circumferential width W and opening onto the first end 8. In use, the housing 6 is mounted with the cylindrical axis 14 thereof in a substantially horizontal orientation on the back of the inner sliding door 4.

Figure 3:
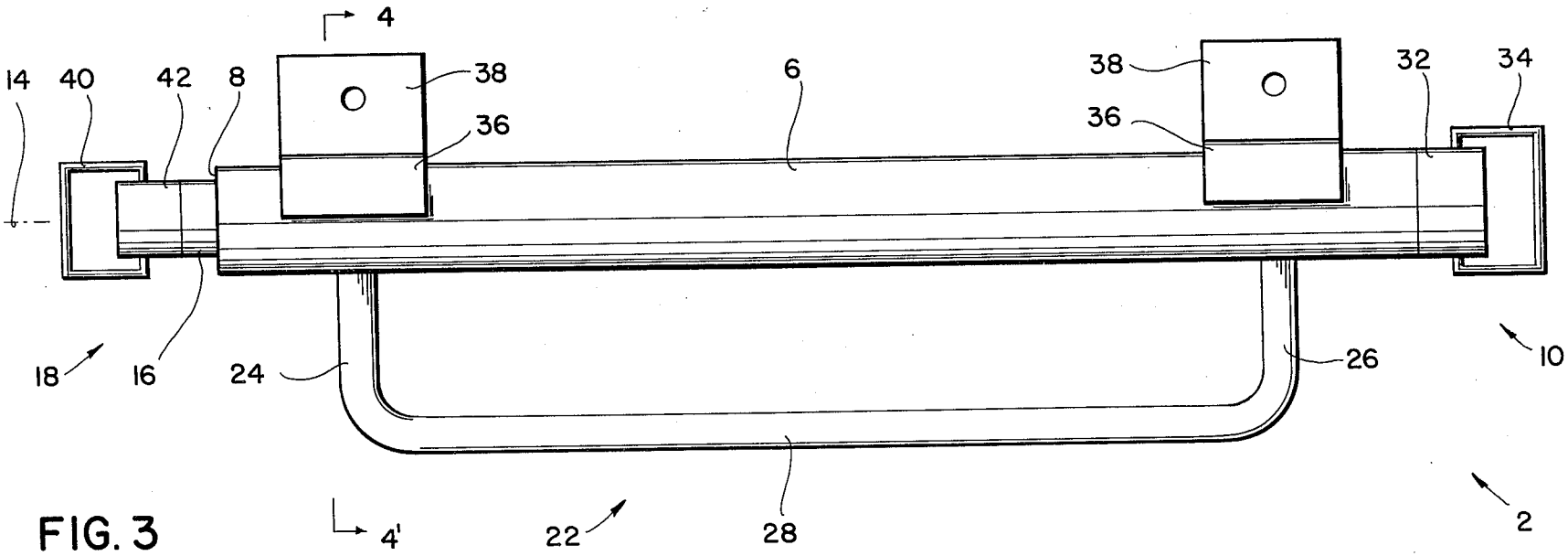
FIG. 3 is a front view of the invention showing the tube 16 fully inserted into the housing 6.
Figure 7:
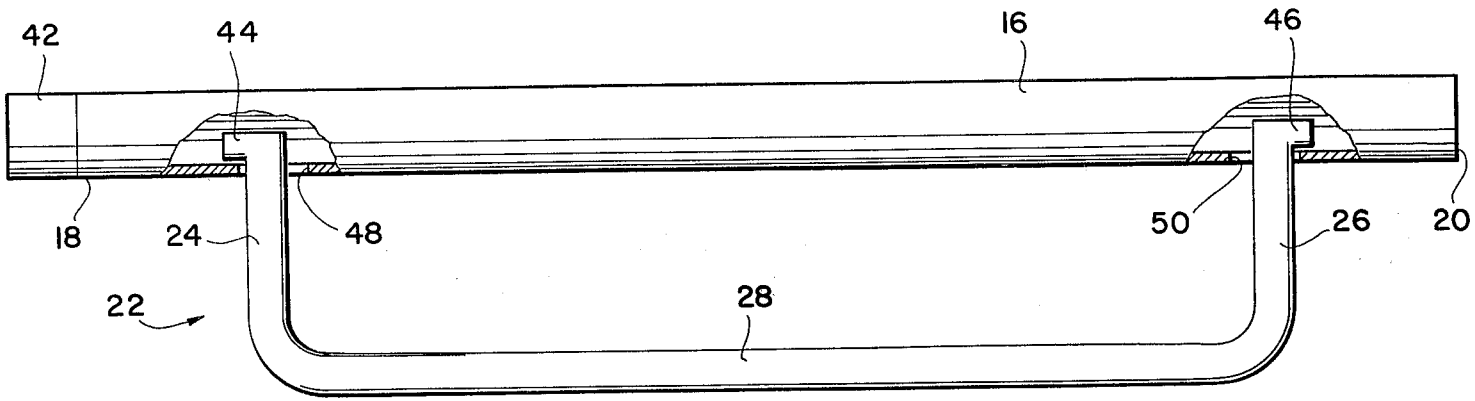
FIG. 7 is a side view of the tube 16 showing the mounting of the bar 22 thereon.
Figure 8:
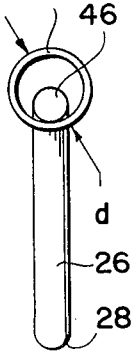
FIG. 8 is an end view of the tube 16 and bar 22.

The tie rack 2 further includes an elongated, cylindrical tube 16 as seen in FIGS. 1, 2, 4, 7 and 8, having an outer diameter of a second dimension d as shown in FIG. 8 which is less than the first dimension D, having a first end 18 and a second opposed end 20 which slideably enters the first end 8 of the housing 6, for mounting within the hollow interior of the housing 6 in axially slideable engagement therewith, as shown in FIGS. 2 and 3.

Figure 4:
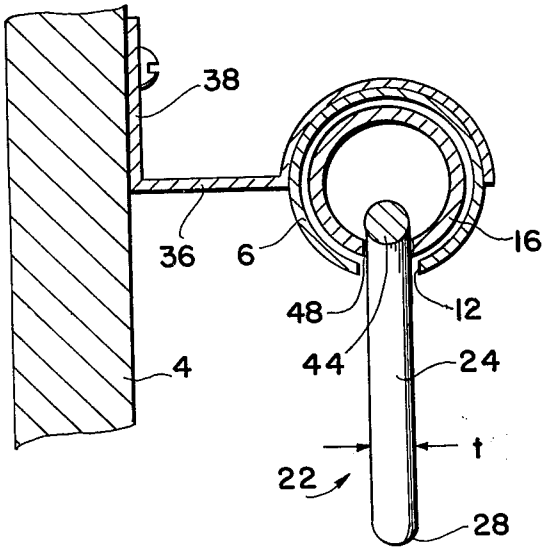
FIG. 4 is a cross sectional view along lines 4—4' of FIG. 3.

The tie rack 2 further includes a bar 22 as seen in FIGS. 1, 3, 4, 7 and 8 having a cross sectional dimension t as shown in FIG. 4 which is less than the circumferential width W of the slot 12 in the housing 6. The bar 22 has a first end 24 mounted to the first end 18 of tube 16, a second end 26 mounted to the second end 20 of the tube 16, and an intermediate horizontal rack portion 28 between the first end 24 and second end 26 thereof suspended in spaced, parallel relationship with the tube 16 as shown in FIG. 7. The bar 22 projects through the slot 12 in the housing 6 and is in axially slideable engagement therewith, as shown in FIG. 4.

In this manner, neckties 30 may be hung from the horizontal rack portion 28 of the bar 22 as shown in FIG. 1, when the tube 16 extends out from the first end 8 of the housing 6 in the deployed position of FIG. 1. Then the tube 16 can be substantially completely slideably inserted into the housing 6 to form a more compact tie rack as shown in FIG. 3, which can be concealed behind the door 4 to enable the door 4 to be closed.

Figure 5:
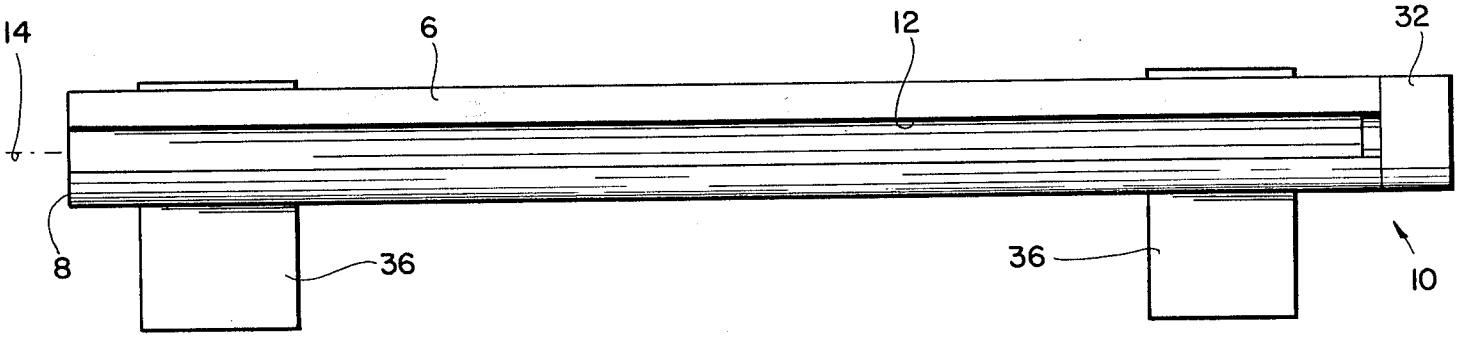
FIG. 5 is a bottom view of the housing 6, showing the slot 12.
Figure 6:
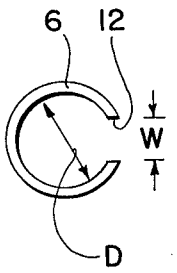
FIG. 6 is an end view of the housing 6.

As is seen in FIG. 5, the housing 6 further includes a cap 32 mounted to the second end 10 of the housing 6, for preventing the tube 16 from sliding out from the second end 10 thereof. The cap 32 can be removed from the second end 10 by means of the pull ring 34, and alternately mounted on the first end 8 of the housing 6, so as to enable the tube 16 to slide out to a deployed position opposite to that shown in FIG. 1, if desired.

As is seen in FIGS. 2, 3, 4 and 5, the housing further includes two mounting brackets 36 welded to the housing 6, extending transversely from the housing 6 and terminating in a mounting surface 38, for fastening the mounting surface 38 to the door 4 as shown in FIG. 4, to suspend the housing 6 in spaced, parallel relationship with the door 4. In this manner, clearance is provided between the ties 30 hung on the bar 22 and the door 4.

As is seen in FIG. 7, the tube 16 further includes a pull ring 40 mounted on a cap 42 which is mounted on the first end 18 of the tube 16, to enable the grasping of the tube 16 to pull it from the housing 6 into the deployed position shown in FIG. 2. The cap 42 can be removed from the first end 18 and alternately mounted on the second end 20 of the tube 16, to change its direction of deployment.

As is shown in FIG. 7, the bar 22 further includes a first axial projection 44 from the first end 24 thereof directed away from the intermediate portion 28. The bar 22 further includes a second axial projection 46 from the second end 26 thereof directed away from the intermediate portion 28 in the opposite direction from that of the first projection 44. The tube 16 has a first mounting hole 48 through the side thereof at the first end 18 thereof for inserting the first axial projection 44 therein. The tube 16 has a second mounting hole 50 through the side thereof at second end 20 thereof for inserting the second axial projection 46 therein. The bar 22, which can be made from a resilient steel rod, is mounted to the tube 16 by bending the rack portion 28 outwardly so that the projections 44 and 46 point toward and are aligned with the holes 48 and 50, respectively. When projections 44 and 46 are then inserted into the holes 48 and 50, the rack portion 28 can be released and it will spring back into its straight shape, locking the bar 22 in place on the tube 16.

In the preferred embodiment, the first dimension D of the inner diameter of the housing 6 is substantially $\frac{3}{4}$ inch and the second d of the outer diameter of the tube 16 is substantially 11/16 inch. The circumferential width W of the slot 12 is greater than $\frac{1}{8}$ inch and the cross sectional dimension t of the bar 22 is substantially $\frac{1}{8}$ inch. The housing 6 has an axial length of approximately 23 inches, the tube 16 has an axial length of approximately 23 inches, and the intermediate portion 28 of the bar 22 has an axial length of approximately 21 inches.

The resulting tie rack can be selectively deployed from either side of a sliding door and yet can be effectively concealed behind the door when the tube is fully inserted into the housing.

Although a specific embodiment of the invention has been disclosed, it will be understood by those having skill in the art, that changes can be made in the details of the structure without departing from the spirit and scope of the invention.

What is claimed is:

1. A hideaway tie rack for a sliding door closet, comprising:

an elongated, hollow cylindrical housing having an inner diameter of a first dimension, having a first open end and a second opposed end, with a longitudinal slot extending axially along the surface thereof having a circumferential width and opening onto said first end, for mounting with the cylindrical axis thereof in a substantially horizontal orientation on said sliding door;

an elongated cylindrical tube having an outer diameter of a second dimension less than said first dimension, having a first end and a second opposed end which slideably enters said first end of said housing, for mounting within the hollow interior of said housing in axially slideable engagement therewith;

a bar having a cross sectional dimension less than said circumferential width of said slot in said housing, with a first end mounted to said first end of said tube, a second end mounted to said second end of said tube, and an intermediate horizontal rack portion between said first and second ends thereof suspended in spaced, parallel relationship with said tube and projecting through said slot in said housing and in axially slideable engagement therewith;

said bar further comprising:

a first axial projection from said first end thereof directed away from said intermediate portion;

a second axial projection from said second end thereof directed away from said intermediate portion in the opposite direction from that of said first projection;

said tube having a first mounting hole through the side thereof at said first end thereof for inserting said first axial projection therein;

said tube having a second mounting hole through the side thereof at said second end thereof for inserting said second axial projection therein;

whereby neckties may be hung from said horizontal rack portion of said bar when said tube extends out from said first end of said housing in a deployed position and then said tube can be substantially completely slideably inserted into said housing to form a more compact tie rack which can be concealed behind said door to enable said door to be closed.

2. A hideaway tie rack for a sliding door closet, comprising:

an elongated, hollow cylindrical housing having an inner diameter of a first dimension, having a first open end and a second opposed end, with a longitudinal slot extending axially along the surface thereof having a circumferential width and opening onto said first end, for mounting with the cylindrical axis thereof in a substantially horizontal orientation on said sliding door;

an elongated cylindrical tube having an outer diameter of a second dimension less than said first dimension, having a first end and a second opposed end which slideably enters said first end of said housing, for mounting within the hollow interior of said housing in axially slideable engagement therewith;

a bar having a cross sectional dimension less than said circumferential width of said slot in said housing, with a first end mounted to said first end of said tube, a second end mounted to said second end of said tube, and an intermediate horizontal rack portion between said first and second ends thereof suspended in spaced, parallel relationship with said tube and projecting through said slot in said housing and in axially slideable engagement therewith;

said tube further comprising a pull ring mounted on said first end of said tube, to enable the grasping of said tube to pull it from said housing into said deployed position;

a first cap mounted onto said first end of said tube;

said pull ring being mounted onto said first cap;

said first cap can be selectively mounted on said first end or said second end of said first end or said second end, respectively, of said housing;

whereby said closet door can be alternately opened from either side to gain access to said ties.

3. The tie rack of claim 2, wherein said housing further comprises:

a second cap mounted to either said second end or said first end of said housing opposite to the end of said tube on which said first cap is mounted, for alternately preventing said tube from sliding out from said second end or said first end, respectively, of said housing.

4. The tie rack of claim 3, which further comprises:

a second pull ring mounted on said second cap, to enable grasping said second cap to remove it from said housing.

5. A hideaway article rack, comprising:

an elongated, hollow cylindrical housing having an inner diameter of a first dimension, having a first open end and a second opposed end, with a longitudinal slot extending axially along the surface thereof having a circumferential width and opening onto said first end, for mounting with the cylindrical axis thereof in a substantially horizontal orientation on a vertical surface;

an elongated cylindrical tube having an outer diameter of a second dimension less than said first dimension, having a first end and a second opposed end which slideably enters said first end of said housing, for mounting within the hollow interior of said housing in axially slideable engagement therewith;

a bar having a cross sectional dimension less than said circumferential width of said slot in said housing, with a first end mounted to said first end of said tube, a second end mounted to said second end of said tube, and an intermediate horizontal rack portion between said first and second ends thereof suspended in spaced, parallel relationship with said tube and projecting through said slot in said housing and in axially slideable engagement therewith;

said housing further comprising at least one mounting bracket mounted to said housing, extending transversely from said housing and terminating in a mounting surface, for fastening said mounting surface to said vertical surface to suspend said housing in spaced, parallel relationship with said vertical surface;

said tube further comprising a pull ring mounted on said first end of said tube, to enable the grasping of said tube to pull it from said housing into said deployed position;

said bar further comprising;

a first axial projection from said first end thereof directed away from said intermediate position;

a second axial projection from said second end thereof directed away from said intermediate portion in the opposite direction from that of said first projection;

said tube having a first mounting hole through the side thereof at said first end thereof for inserting said first axial projection therein;

said tube having a second mounting hole through the side thereof at said second end thereof for inserting said second axial projection therein;

whereby said bar is mounted to said tube.

6. The article rack of claim 5, which further comprises:

said mounting bracket being welded to said housing.

7. The article rack of claim 6, which further comprises:

a cap mounted onto said first end of said tube;

said pull ring being mounted onto said cap;

whereby said tube can be deployed for access to the articles on said rack.

* * * * *